US006817302B2

(12) United States Patent
Norstad

(10) Patent No.: US 6,817,302 B2
(45) Date of Patent: Nov. 16, 2004

(54) FOLDABLE DISPLAY BENCH

(75) Inventor: Donald Norstad, Randolph, MN (US)

(73) Assignee: Poly-Tex, Inc., Castle Rock, MN (US)

( * ) Notice: Subject to any disclaimer, the term of this patent is extended or adjusted under 35 U.S.C. 154(b) by 161 days.

(21) Appl. No.: 10/298,589

(22) Filed: Nov. 19, 2002

(65) Prior Publication Data

US 2004/0094075 A1 May 20, 2004

(51) Int. Cl.[7] ..... A47B 3/00
(52) U.S. Cl. ..... 108/115
(58) Field of Search ..... 100/115, 116, 100/193, 162, 169, 170, 173, 174; 211/134, 149, 150, 153, 168, 169, 195, 204, 205, 181.1

(56) References Cited

U.S. PATENT DOCUMENTS 3,436,092 A * 4/1969 Werner ..... 108/115
3,527,174 A * 9/1970 Lay ..... 108/115
5,257,701 A * 11/1993 Edelson ..... 108/116
5,622,119 A * 4/1997 Hsieh ..... 108/115
5,904,104 A * 5/1999 Yu ..... 108/116
6,082,838 A * 7/2000 Bissu-Palombo ..... 108/115
6,314,892 B1 * 11/2001 Favini ..... 108/115
6,394,290 B1 * 5/2002 Walsh et al. ..... 108/115
6,431,091 B1 * 8/2002 Chang ..... 108/115
6,598,543 B1 * 7/2003 Ellsworth et al. ..... 108/115
6,698,364 B2 * 3/2004 Welch et al. ..... 108/115

FOREIGN PATENT DOCUMENTS

DE 3514603 A1 * 10/1986 ..... A47B/13/04

* cited by examiner

*Primary Examiner*—Jose V. Chen

(57) ABSTRACT

A foldable display bench is described for supporting items on display. The display bench assembly comprises support structures for detachable shelves. While being employed as a display bench, the shelves are detachably secured to the support structure. When it comes time to dismantle and display bench for storage or repositioning, the shelves are detached from the support structure which can then be folded into a substantially flat configuration.

1 Claim, 6 Drawing Sheets

FOLDABLE DISPLAY BENCH

FIELD OF THE INVENTION

This invention is directed to a foldable display bench, for supporting items on display. The bench provides a support structure for shelves. The shelves can be removed and the support structure folded into a substantially flat configuration.

BACKGROUND OF THE INVENTION

There are numerous circumstances where it is desirable to display items for sale on surfaces where they can be conveniently seen and closely examined by prospective customers. One such circumstance is in retail greenhouses, where live plants are displayed on both sides of aisles leading through the green house.

Such display areas are not static. The displays are constantly changing, often requiring a reconfiguration of the display area. Greenhouses and greenhouse display structures are generally dismantled for storage during off season. Display benches must frequently be disassembled for storage and repositioning. The display benches presently in use have numerous detachable components that are easily misplaced or lost during disassembly and storage. Furthermore, assembling and disassembling the display benches is a tedious and time consuming effort that is costly to the greenhouse operator.

It is an object of this invention to provide a display bench, which has a minimal number of detachable components, and can be readily folded into a substantially flat configuration for storage or repositioning.

DISCLOSURE OF THE PRIOR ART

Various display benches that have two or more shelves, where items can be conveniently seen and examined are common fixtures in greenhouses. One such is disclosed in U.S. Pat. No. 5,553,551. But none of which applicant is aware, anticipate a foldable support structure for the display surfaces.

SUMMARY OF THE INVENTION

In accordance with the present invention, an assembly is provided to form a foldable bench for supporting items on display. The bench provides a support structure for shelves. The support structure consists of a back frame stabilizer, on opposite sides of which are foldably connected leg frames. The leg frames can thus be folded out into a position at a right angle to the back frame stabilizer. With the leg frames in this position, shelves are placed on the supporting surfaces of the leg frames. The shelves fit on to the supporting surfaces of the leg frames in such a way as to engage them and maintain them in that right angle position. So when the shelves are engaged, the leg frames are no longer foldable.

When it is desirable to temporarily dismantle the bench, the shelves can be lifted out of engagement with the supporting surfaces of the leg frames. The leg frames can then be folded inwardly to a position adjacent and parallel to the back frame stabilizer, thus forming a flat, compact assembly.

The back frame stabilizer consists of a top bar and a bottom bar parallel to one another and diagonal bars connecting them. This structure resists any tendency to twist under pressure, so the back frame stabilizer is maintained as a flat structure with all elements parallel to each other.

The support surfaces of the shelves are slats or mesh or other such porous material as to allow water oozing from nursery stock to readily drip through without creating a puddle or accumulation of liquid on the surface of the shelves.

Reference will now be made in detail to the present preferred embodiment of the invention.

Figure 1:
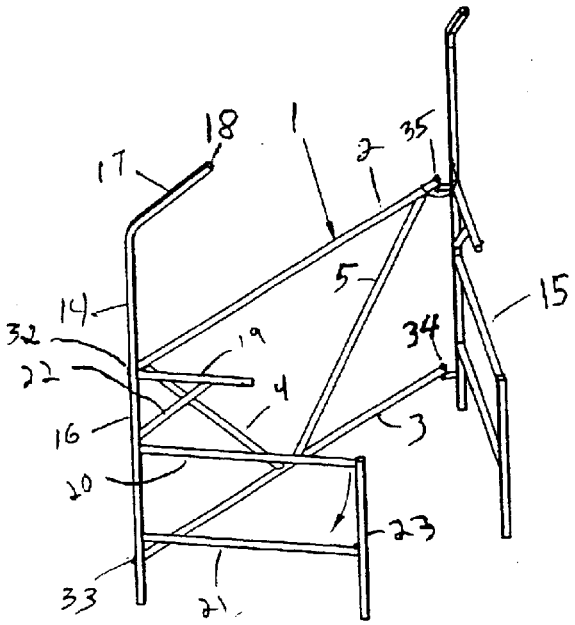
FIG. 1 is a perspective view of the foldable display bench assembly in a partially unfoldable position.
Figure 2:
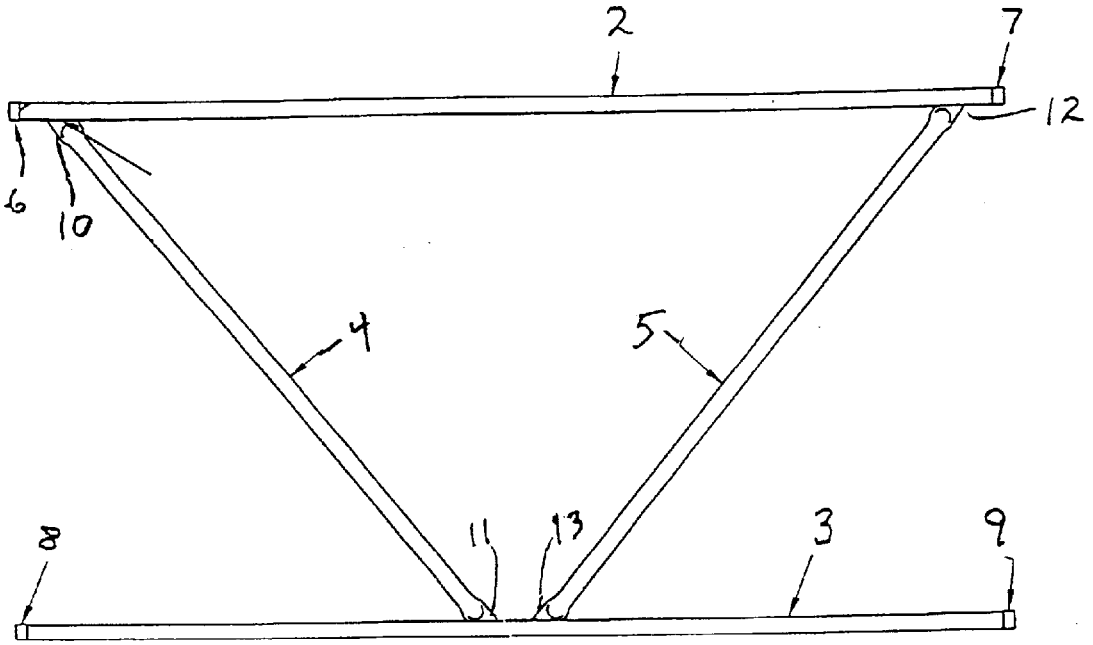
FIG. 2 is a front elevation view of the stabilizer of the foldable display bench.
Figure 3:
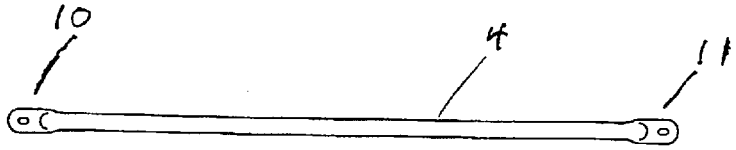
FIG. 3 is a front elevation view of a diagonal bar of the stabilizer.
Figure 4:
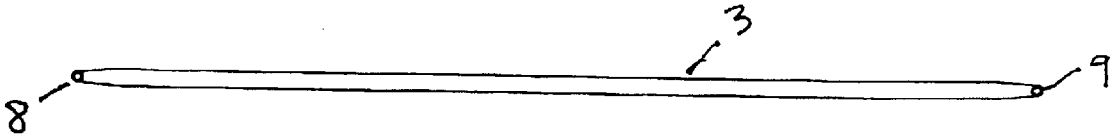
FIG. 4 is a top plan view of the bottom bar of the stabilizer.
Figure 5:
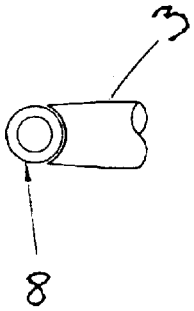
FIG. 5 is a detail view of the end of the bottom stabilizer bar bearing ring.

FIG. 1 illustrates the display bench assembly in the position of being partially unfolded. It includes a back frame stabilizer 1, a left side panel 14 and a right side panel 15. The left side panel 14 is foldably connected to back frame stabilizer 1, by hinges 32 and 33. The right side panel 15 is foldably connected to back frame stabilizer 1, by hinges 34 and 35.

The back frame stabilizer is illustrated in FIG. 1, FIG. 3, FIG. 4 and FIG. 5. It comprises a top bar 2, a bottom bar 3, and diagonal bars 4 and 5, extending between and connecting top bar 2 and bottom bar 3. The diagonal bar 4 has flattened end positions 10 and 11. The diagonal bar 5 has similar flattened end portions 12 and 13. The flattened end portions 10, 11, 12 and 13 are provided to facilitate a rigid and permanent attachment to top bar 2 and bottom bar 3 by means of metal screw, bolt, spot welding or other conventional methods. The top bar 2 has on its opposite ends bearing rings 6 and 7. The bottom bar 3 has on its opposite ends bearing rings 8 and 9. The bearing rings 6, 7, 8 and 9 form a portion of the hinges 32, 33, 34 and 35.

Figure 6:
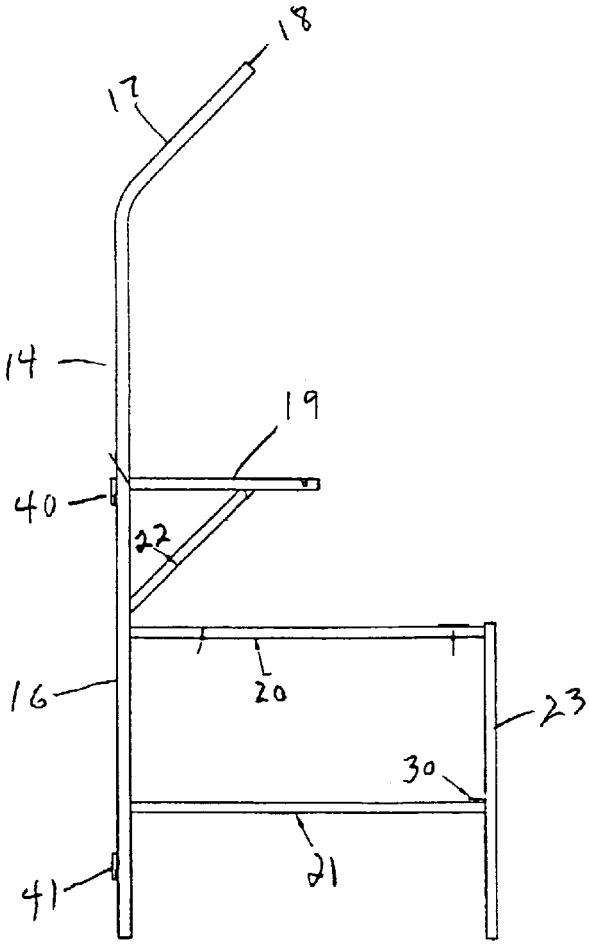
FIG. 6 is a front elevation view of the left side panel.

The left side panel 14, as illustrated in FIG. 6, comprises a back leg 16, the top portion of which is bent forward at an approximate 45° angle forming a shoulder 17 with a tubular open end 18. Extending forward from back leg 16, and rigidly affixed thereto is upper shelf support 19. A support strut 22 extends diagonally between back leg 16 and upper shelf support 19 and is rigidly affixed. Middle shelf support 20 and bottom shelf support 21, extend between and are rigidly affixed to back leg 16 and front leg 23.

Figure 7:
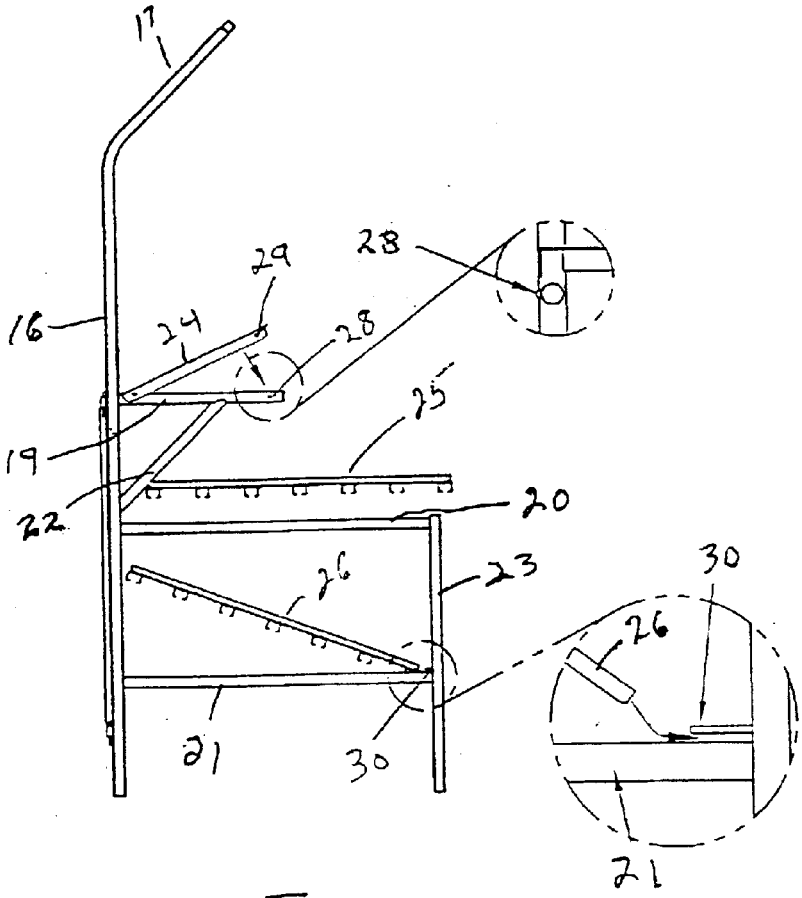
FIG. 7 is a front elevation view of the left side of the panel showing placement of shelves.
Figure 8:
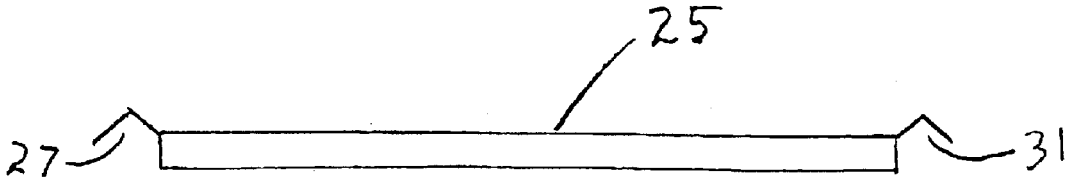
FIG. 8 is a front elevation view of the shelf.

As illustrated in FIG. 7, the upper shelf 24 fits down onto upper shelf support 19. Middle shelf 25 fits down onto middle shelf support 20; bottom shelf 26 fits down onto bottom shelf support 21. Middle shelf 25 is illustrated in FIG. 8. It is comprised of parallel slats which extend between end portions that form left channel 27 and right channel 31. Left channel 27 fits down over and engages the middle shelf support 20. The right channel 31 fits down over and engages the middle shelf support of right side panel 15. Right side panel is substantially identical to left side panel 14.

Figure 9:
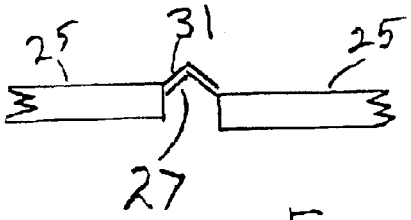
FIG. 9 is a front elevation view of two adjacent shelves with interlocking end channels.

FIG. 9 illustrates an optional utilization of the structure of shelf 25. Where it is desired to form a run of adjacent display benches, end channel 27 fits down over and engages shelf support 20. End channel 31 of an adjacent shelf 25, fits down over and engages end channel 27.

Extending back from front leg 23, immediately above and parallel to bottom shelf support 21 is the holding bracket 30. When bottom shelf 26 is fitted down onto bottom shelf support 21, its front end is inserted beneath bracket 30, which secures it from sliding forward or out of engagement with the shelf support 21.

On the forward end of upper shelf support 19, there is a snap button 28, (which is a spring urged, rounded projection that can be depressed but snaps back when not depressed). There is a corresponding aperture 29, on the outer front edge of upper shelf 24. When upper shelf 24 is fitted down upon upper shelf support 19, the snap button 28 is depressed, but when it aligns with corresponding aperture 29, it snaps out, which secures the upper shelf 24 from sliding forward or out of engagement with the upper shelf support 19.

Figure 10:
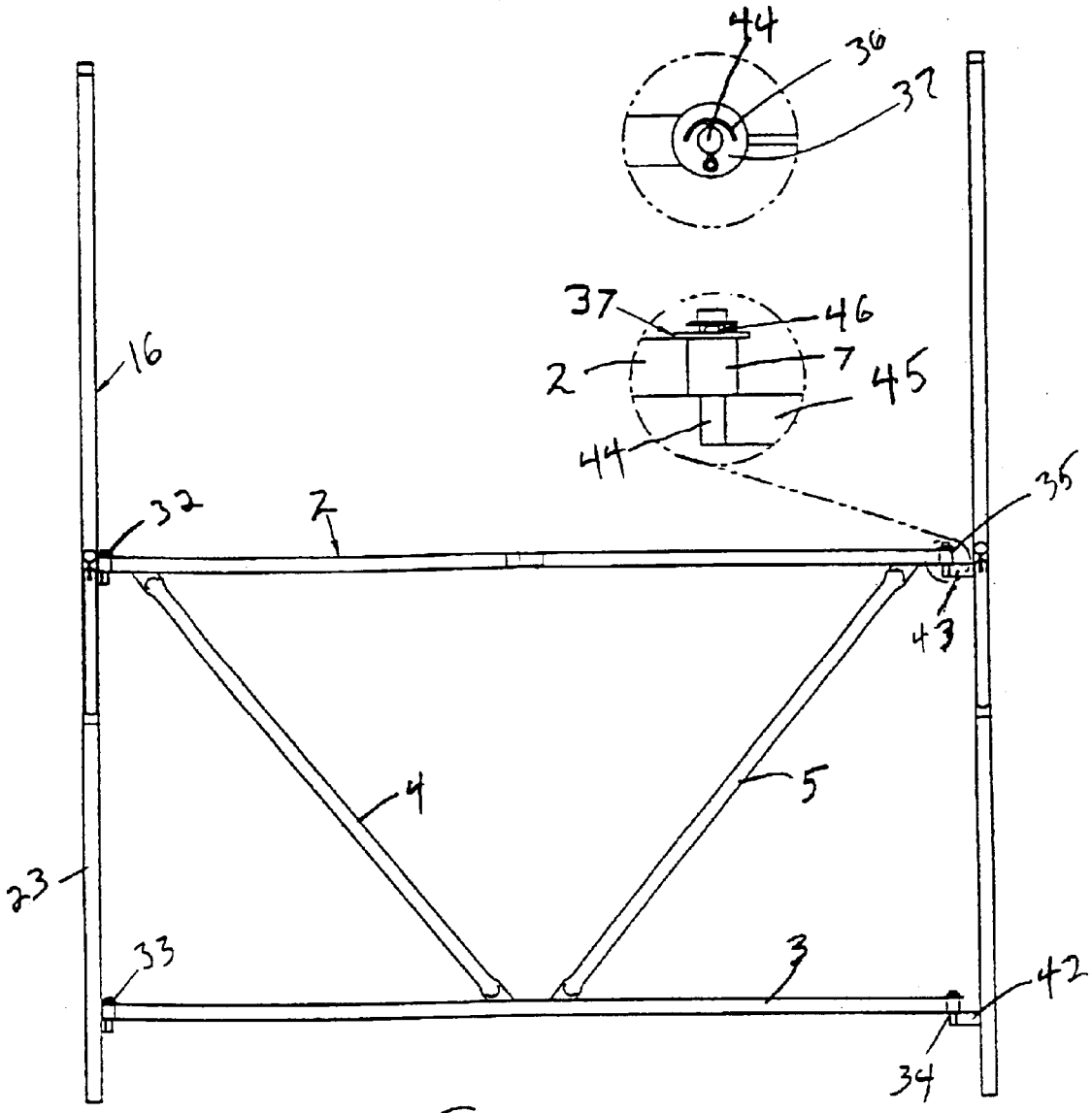
FIG. 10 is a front elevation view of the display bench assembly.

Hinges 32, 33, 34 and 35, are formed of bearing rings 6, 7, 8 and 9 with side panel hinge elements 40, 41, 42 and 43. Side panel hinge element 40 is illustrated in FIG. 10. It comprises a linchpin 44, and linch pin support 45. The linch pin support 45 is rigidly affixed to back leg 16. There is an aperture 46 toward the top of linchpin 44. It will be appreciated from the enlarged portions of FIG. 9, that linchpin 44 extends up and through the bearing ring 7, and a flat washer 37. Cotter pin 36, is extended through aperture 46 and expanded so as to hold linchpin 44 in position relative to bearing ring 7 and moveable relative thereto. Linchpin 44 and bearing ring 7, essentially form the hinge 35.

Figure 11:
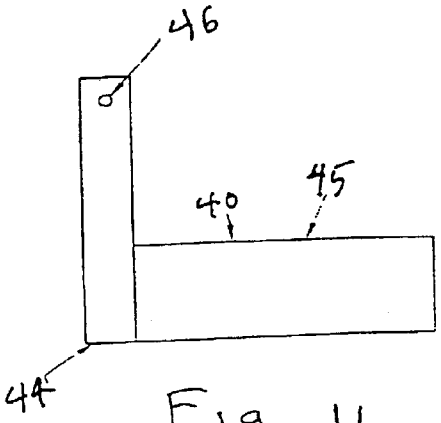
FIG. 11 is a side elevation view of the hinge linchpin.
Figure 14:
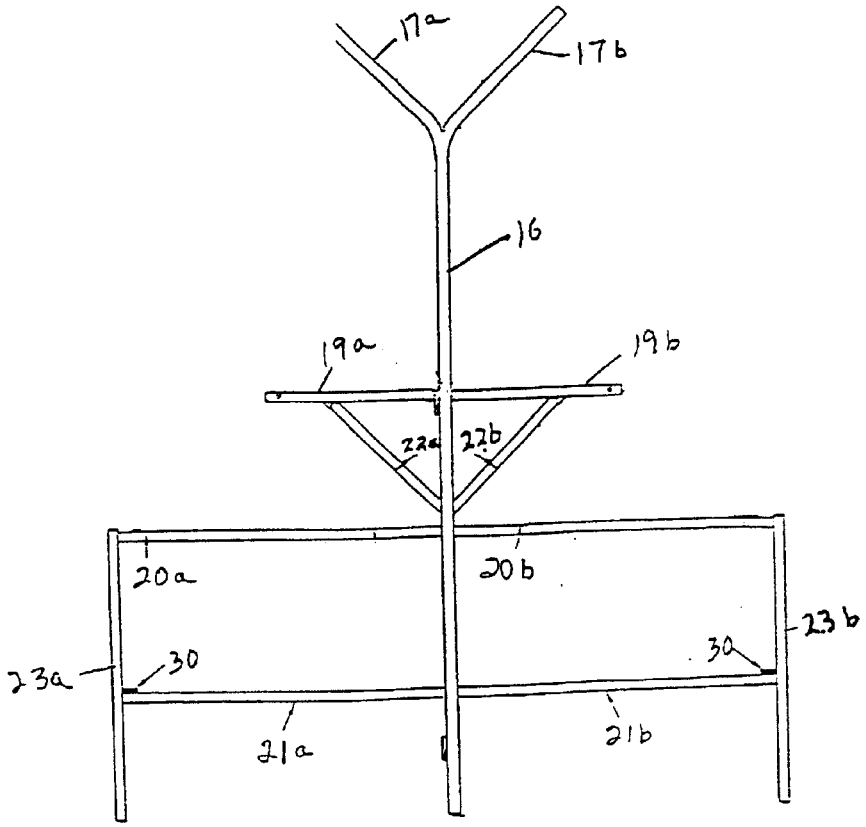
FIG. 14 is the side elevation view of an alternate form of the invention, in which two bench assemblies are foldably joined to a shared stabilizer.

The purlin 38 is illustrated in FIG. 11. It is a bar having an insertion element 39, at each end. The insertion elements 39 are of a size and shape to fit snugly into the open ends 18 of shoulders 17. Plant containing baskets can be hung from the purlin 38, thus further enhancing the display capacity of the foldable display bench.

Figure 12:
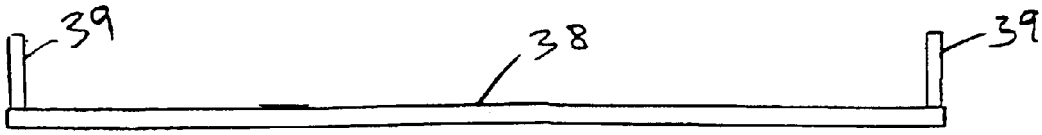
FIG. 12 is a top plan view of the purlin.
Figure 13:
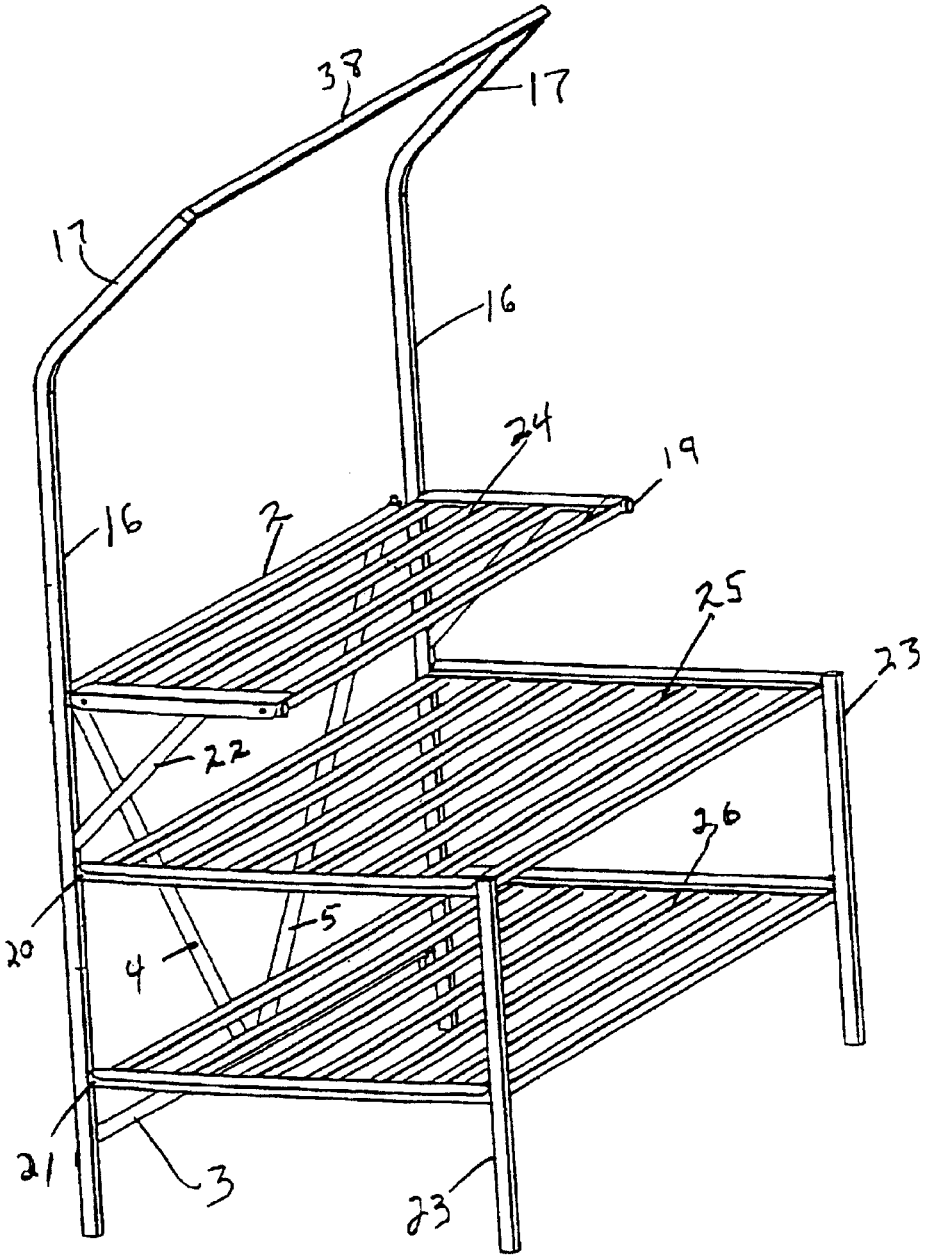
FIG. 13 is a side perspective view of said display bench fully assembled.

FIG. 12 shows the foldable display bench in a filly assembled position. FIG. 13 illustrates a variation of the preferred embodiment, which is in effect two display benches, back to back and extending from a shared back frame stabilizer.

It will be apparent to those skilled in the art that various modifications and variations can be made in the foldable display bench without departing from the spirit or scope of the invention. Thus, it is intended that the present invention cover the modification and variations of this invention provided that they come within the scope of the appended claims and their equivalents.

What is claimed is:

1. A bench for supporting items on display comprising:

a back frame stabilizer having at least two horizontal bars, and two diagonal bars extending between and rigidly attached to said horizontal bars;

at least two side panel frames hingably attached to said back frame stabilizer, so that they can swing into a position perpendicular to the said back frame stabilizer, each of said side panels having a back leg, a front leg and at least two horizontal supports extending between and rigidly attached to said legs; and at least two shelves detachably secured to said horizontal supports;

a first set of side panels hingably attached and extendable forward from said back frame stabilizer, and a second set of side panels substantially identical to said first set, but extendable rearward from said back frame stabilizer and hingably attached thereto.

* * * * *